US005326109A

United States Patent [19]

Robl

[11] Patent Number: 5,326,109

[45] Date of Patent: Jul. 5, 1994

[54] PORTABLE NET HOLDING ASSEMBLY

[76] Inventor: Daniel P. Robl, 95 Waukau Ave., Oshkosh, Wis. 54901

[21] Appl. No.: 51,516

[22] Filed: Apr. 26, 1993

[51] Int. Cl.[5] ..... A63B 67/00

[52] U.S. Cl. ..... 273/411

[58] Field of Search ..... 273/411, 1.5 A, 26 R, 273/26 A, 29 B, 29 BA, 29 BC

[56] References Cited

U.S. PATENT DOCUMENTS

| | | | |
|---|---|---|---|
| 4,415,163 | 11/1983 | Schoenig | 273/411 |
| 4,720,112 | 1/1988 | Stettner et al. | 273/411 |
| 4,732,395 | 3/1988 | Halverson | 273/411 |
| 4,830,382 | 5/1989 | Wheeler | 273/411 |
| 4,948,149 | 8/1990 | Lin et al. | 273/411 |
| 5,106,101 | 4/1992 | McKay | 273/411 |
| 5,180,143 | 1/1993 | Browers | 273/411 X |

FOREIGN PATENT DOCUMENTS

| | | | |
|---|---|---|---|
| 3823570 | 1/1990 | Fed. Rep. of Germany | 273/411 |
| 1015722 | 10/1952 | France | 273/411 |

*Primary Examiner*—William Stoll
*Attorney, Agent, or Firm*—R. Jonathan Peters

[57] ABSTRACT

A portable net holding assembly for volley ball and the like comprises two identical halves. Each half of the assembly includes a substantially planar base member having (i) at least one downwardly depending spike adaptable for insertion into the ground adjacent the playing area in order to secure or hold the base to the ground when in a deployed position or playing position, and (ii) an upwardly depending, centrally located male stud. An end pole has a longitudinal recess at one end for accommodating the male stud of the base. A plurality of elongated stakes, preferably two, are adaptable to be inserted into the ground at spaced apart points remote from the base member and outwardly from the playing area. A set of lines extend from the pole to each of the stakes and are releasably connected thereto in a deployed position, and the pole has longitudinally spaced connecting elements for releasably connecting a net thereto.

3 Claims, 2 Drawing Sheets

PORTABLE NET HOLDING ASSEMBLY

FIELD OF INVENTION

This invention relates to a net holding assembly. In its more specific aspect, this invention relates to a portable net holding assembly that can be readily deployed as at a playground, beach or the like, for volley ball or other net games.

BACKGROUND AND PRIOR ART

The prior art shows a number of net support assemblies for such games as tennis, volley ball, badminton, etc., and many of these are portable so that the assembly can be deployed at a selected location such as a park or playground. With any net-game, it is essential that the net remain taut, and be set to the correct playing height and maintain that height or be re-adjusted to the correct height when in play. Further, the supports for the net must remain sturdy and durable, and not lean under the rigors of the game. Moreover, a portable assembly should not be unduly complicated to assemble, especially when the net-game is frequently assembled in a public area for a relatively short period of use such as for a day or a fraction of a day.

The prior art includes, for example, U.S. Pat. No. 3,980,299 to Brown which describes a kit for constructing a tennis court, having a net support means comprising two end poles for holding the net at the ends strung at midcourt and a center pole for holding the net upright, which are threadedly engaged with disc-shaped bases anchored to the ground. No accessory parts or equipment is used to sturdy the net and to hold it taut, and therefore the poles and base must be firmly anchored, which manifests a difficult assembly and one that is not readily transportable. Furthermore, a center pole used as an auxiliary support can be an interference with the game, and can be hazardous to the players. Similarly, U.S. Pat. No. 5,106,101 to McKay discloses a game-net support of essentially a permanent mounting comprising a hollow post welded to base having a downwardly depending spike for insertion into the ground.

A portable net-game assembly is shown in U.S. Pat. No. 4,979,754 to Eisenhart. Each net-support unit, positioned mid-court, comprises a hollow base and post, which can be filled with sand or water to provide weight and support to the units. In U.S. Pat. No. 3,968,968 to Peterson, the end posts for holding the net are screw-threaded to the base, which complicates the assembly. U.S. Pat. No. 4,093,224 to Hale discloses a stanchion assembly for holding a net, comprising a base of spaced apart, parallel ground engaging support members, and spaced apart, parallel cross members, and the stanchion is anchored to the ground with a spike.

This invention has as its object to provide a portable net support assembly, which can be readily assembled for temporary use on the ground or sand, as at a playground, park, or beach, and includes quick adjustment means for retaining the net taut and the poles upright as play continues.

It is another object of the invention to provide such a portable net support assembly which can be re-adjusted at anytime during play.

It is still another object of the invention to provide such an net support which is light weight and can be easily assembled by a single person.

SUMMARY OF THE INVENTION

In accordance with the present invention, there is provided a net holding assembly for volley ball, badminton, tennis, and the like, which assembly is portable and can be deployed readily at a park, playground, yard, beach, etc. The assembly comprises two identical halves, which can be assembled by hand by any person with a minimal of strength, and for example when the ground is particularly hard, one might find it desirable to use a hammer. The assembly includes a pair of upright or vertically disposed poles positioned opposite each other at center court adjacent the playing area, and are supported by a base secured or anchored to the ground. Guy means extend from the poles outwardly from the playing area and are releasably anchored to the ground at spaced apart points remote from the base.

More specifically, each half of the assembly comprises a substantially planar base member having at least one downwardly depending spike adaptable for insertion into the ground adjacent the playing area thereby anchoring the base member to the ground when in a deployed position. It should be understood that the term "ground" as used herein and in the claims includes any relatively soft or penetrable earth surface such as soil, clay, or sand. Further, the base member is provided with an upwardly depending, centrally located projection or male stud. An end pole or end post, preferably in two parts and releasably connected on a common axis, has a longitudinal recess at one end for accommodating the male stud projecting upwardly from the base. Suitable anchoring means comprising a plurality of elongated stakes are inserted into the ground at spaced apart locations remote from the base member and outwardly from the playing area. Guy means, preferably having adjustable means for adjusting the tension when in a deployed position, extend from the pole to the elongated stakes and are releasably connected thereto. In a preferred embodiment, the guy means includes a set of lines extending from the stakes to longitudinally spaced connections at the upper portion or upper part of the pole. Further, the pole includes longitudinally spaced connecting means for releasably connecting a playing net or game net to the assembly, whereby the playing net can be strung across the playing area or court.

DETAILED DESCRIPTION OF THE INVENTION AND PREFERRED EMBODIMENTS

Figure 1:
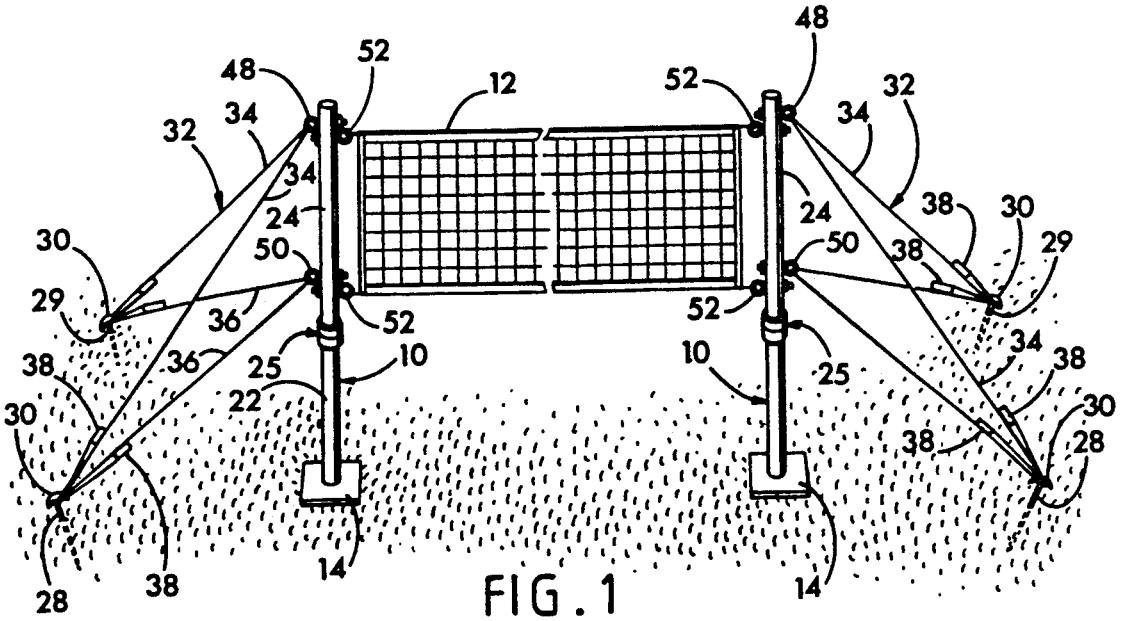
FIG. 1 is a perspective view of the portable net assembly of the present invention shown fully deployed, that is in a playing condition.
Figure 2:
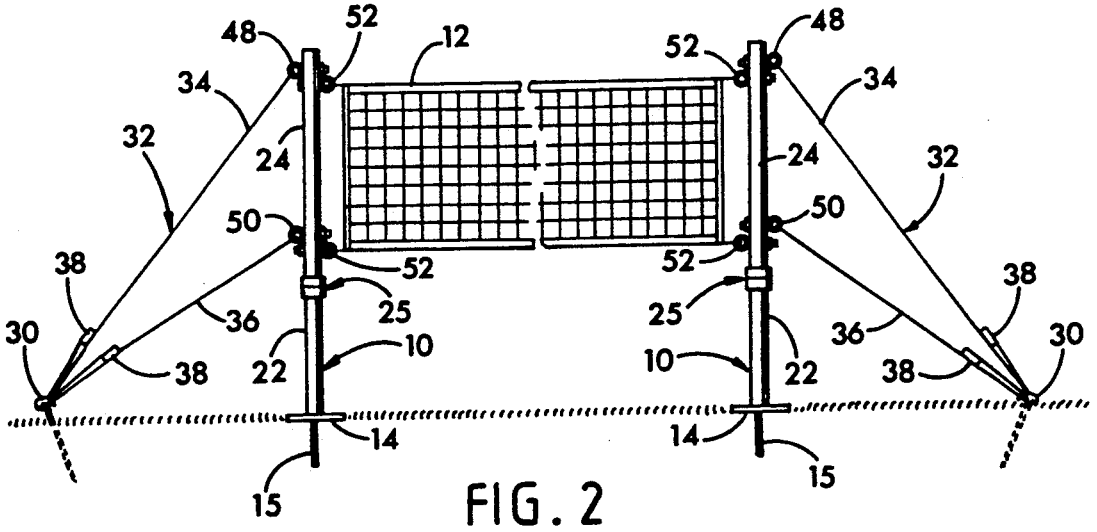
FIG. 2 is a front elevational view showing in greater detail the end post secured to the base positioned in the ground for both sides of the playing net in fragmentary attached to the post and arranged for playing.
Figure 3:
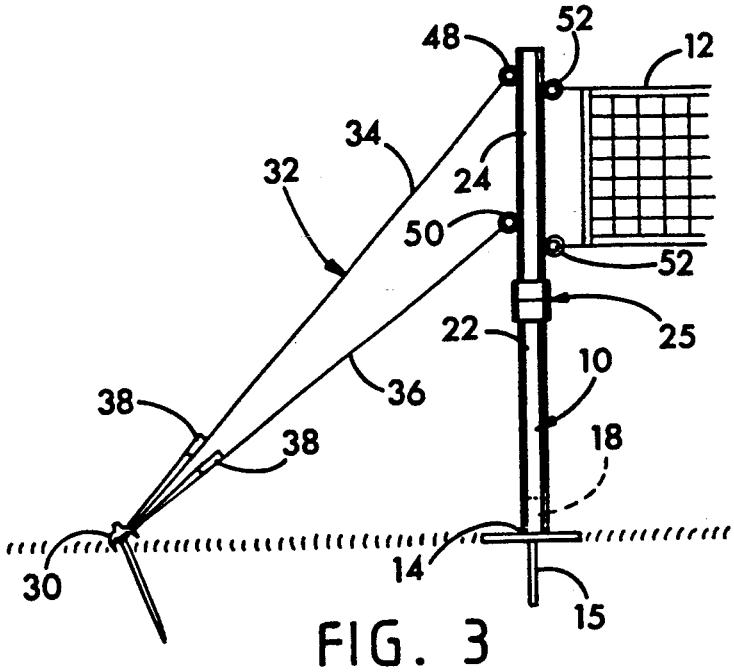
FIG. 3 is a perspective view of the details of FIG. 2.
Figure 4:
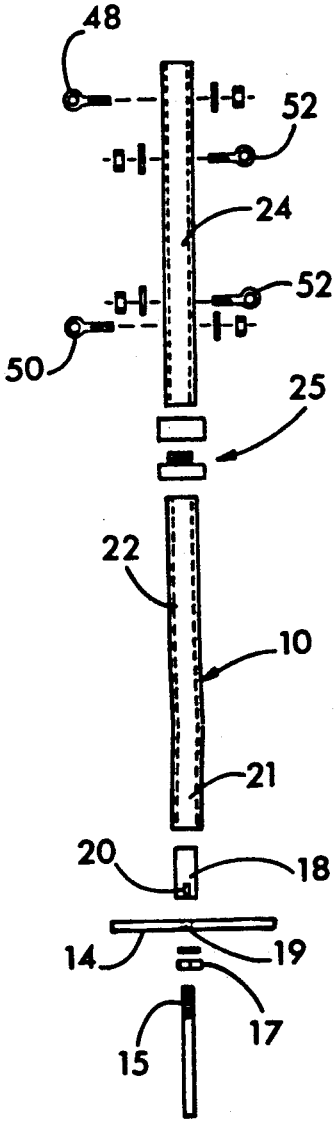
FIG. 4 is an exploded side elevational view showing in greater detail the base member.
Figure 4A:
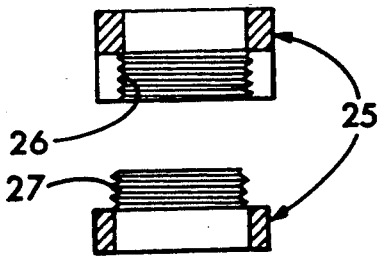
FIG. 4A is a side elevational view in cross-section showing in greater detail the coupling means for the end posts.

Referring to the drawings wherein the same reference numerals refer to similar parts throughout the various views, there is shown in FIG. 1 the portable net assembly of the present invention in a fully displayed or playing condition. It will be observed that the net assembly comprises two identical halves, each half including an end pole, indicated generally at 10, secured upright or vertically so as to hold taut a net 12 suspended between the end poles at midcourt. A substantially planar base member 14 has one or more downwardly depending spikes 15, desirably having the ends reduced or pointed, for insertion into the ground at a midcourt point and adjacent the playing area. (See FIG. 4. ) The base can be formed of metal such as aluminum or steel, or be formed of plastic such as LEXAN (a trademark of General Electric Company), and can have any surface geometry such as circular or rectangular. Further, the base should be of sufficient dimensions so when set firmly on the ground, the base has a sufficient area, together with the guy means, to inhibit tilting or wobbling of the pole when in a deployed position such as shown in FIG. 1. However, the base member should not be so large as to be unduly cumbersome. If the base member has only one downward spike, the spike desirably is centrally disposed. Generally there is no need for more than four spikes, but with a plurality of spikes, the spikes are arranged substantially symmetrically so as to provide a more uniform disposition of the base on the ground. Also, the spikes 15 are of sufficient length so as to provide adequate support and to retain or hold the base in position during play of the game. The spikes are formed integrally or affixed to the base member by conventional means such as by welding or by a bolt. As shown in FIG. 4, the spike 15 may be attached to the base 14 by bolt and tightening nut arrangement (as explained below in greater detail). Thus, the base member is readily positioned and the spikes driven or inserted into the ground simply with body pressure exerted by a person, but if desired a hammer may used to drive the spikes.

The top surface of the base member 14 has an upwardly depending projection or male stud 18, which can be formed integrally with the base or affixed by conventional means such as welding or bolting. In accordance with one embodiment of the invention, base 14 has a central aperture 19, and male stud 18 has an internally threaded slot or recess 20. Aperture 19 and recess 20 are aligned, and spike 15 having externally threaded bolt section 16 is threadedly engaged with the recess 20, and then nut 17 is tightened to ensure a secure attachment. The height of this male stud should be sufficient so that the end post connected to the base, as described below, will be maintained in an upright and sturdy position. Thus, for a typical volley ball assembly on essentially flat ground having end posts approximating the regulation height of the net or just slightly higher (e.g. about 4 to 12 inches higher), I have found a rectangular base to be particularly satisfactory that measures about six inches square and has a male stud of about four to six inches in height. It should be understood, however, that the height of the end poles may be varied depending upon the location of play. For example, if the assembly is mounted to extend across a swimming pool, the poles can be substantially shorter to accommodate for the depth of the pool.

The end pole 22, preferably made of plastic such as polyvinyl chloride, has a longitudinal recess or channel 21 for accommodating male stud 18. For a volley ball assembly desirably having end poles that measure about 96 to 108 inches, the pole is preferably provided in two parts 22 and 24. Thus, the lower pole is recessed at 21, and is connected to the base by inserting the male stud 18 into the recess which has been designed to provide a snug fit. The upper part or upper pole 24 is extendable from the lower pole and connected thereto along a common axis. A suitable coupling means, indicated generally by the numeral 25, is affixed or bonded to the connecting termini of the pole sections 22 and 24, and the coupling means 25 includes an internally threaded female section 26 for engagement with externally threaded male section 27, thereby releasably connecting the lower and upper poles for a deployed or playing position. For a volley ball assembly, the regulation height of the net is 7 ft 11 and ⅝ in, and I have found that end poles having a total length longer than this regulation height, preferably about 100 to 108 inches, provides sturdiness to the assembly.

For each half of the portable assembly there are two elongated stakes 28 and 29, and the stakes preferably are tapered to a reduced or pointed end, for insertion into the ground at spaced apart points remote from the base member 14 and outwardly from the playing area. It will be observed that on assembly in a deployed position, the stakes and the pole at the base define a triangle which, together with the guy means described below, provide stable support for the assembly. At or near the top of each stake is hook 30 (for the reason explained below) which is bent downwardly and positioned so as to be at or slightly above ground level when the stake is inserted or driven into the ground. The top of the stake is relatively flat, or if desired flanged, to facilitate insertion by hand into the ground, and the hook may be affixed to the stake adjacent the flattened or flanged end. Each stake is inserted into the ground at an incline or angle away from the poles, and outside the playing area, so as to position the hook outwardly from the pole. The stakes should be of sufficient length so as to be secure when inserted into the ground, and for play on a soft surface or on sand, it is desirable to use a longer stake. For example, for typical ground surfaces, a stake approximately one foot in length is usually adequate, but if play is more frequent in sand, it may be desirable to use a slightly longer stake, for example a stake about two feet in length.

Figure 5:
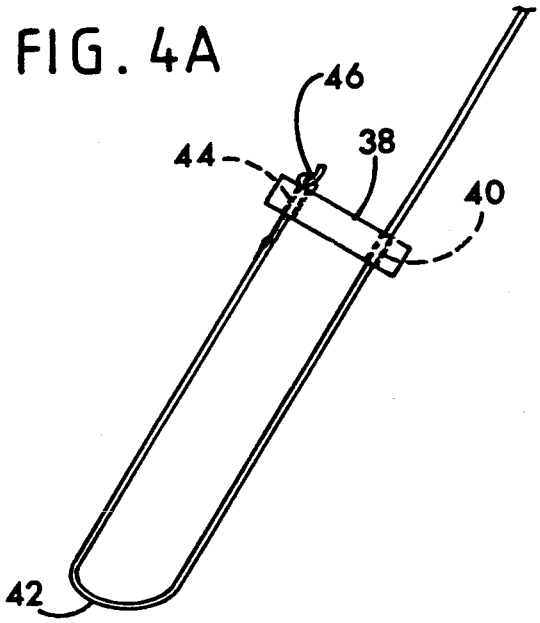
FIG. 5 is a side elevational view of the guy means for adjusting or tensioning the lines when in a deployed position.

Guy means, indicated generally at 32 and 33, comprising a first line 34 and second line 36, such as nylon or polyester rope, extend between the stakes 28 and 29 and the poles and are releasably connected thereto in a deployed position or for a playing position. In a preferred embodiment, and as shown in greater detail in FIG. 5, the first and second lines 34 and 36 are each provided with a cinch block 38 for adjusting the tension of the guy means. Thus, each of the lines is passed through an opening 40 in the cinch block and looped at 42 so as to pass around one of the stakes, such as stake 28, and beneath and held in place by hook 30 which prevents the lines from slipping off the stakes. The line is then passed through opening 44 in the cinch block and is secured by knot 46. Line 34 is passed through eyelet 48 such as an eye bolt, and the line is tied or secured to the eyelet of the end pole 10 at about the mid-point of the line, and similarly line 36 is passed through eyelet 50. The remaining portion of the line (approximately half of the line) then extends to the other stake, such as stake 29, and is held in place by hook 30 and adjusted by cinch block 38. Preferably, when the end pole is in two parts or sections 22 and 24 as shown in the drawings, the line is connected to the upper pole 24. Thus, first line 34 extends from stake 28 to a first point of convergence on pole 24 and then to stake 29, and the second line 36 extends from the stake 28 to a second point of convergence on pole 24 longitudinally spaced from the first point of convergence and then to stake 29. The cinch block makes it possible to adjust the size or diameter of the loops for both lines to facilitate assembly of the structure, and further provides adjustable means to tension the lines so as to make the net taut when deployed for play.

Pole 10, and preferably upper pole 24, is provided with space apart and aligned eyelets 52, which may be formed integrally with the pole or be provided as an eyebolt and affixed to the pole. The playing net 12 is provided with end cords which are clipped or tied to the eyelets, thereby securing the net between the end poles for playing position.

In setting up or assembling the structure, a relatively level area is selected such as at a park or beach. The several parts are laid flat on the ground and in such a manner that the half assemblies are symmetrical. Thus, the pole sections 22 and 24 for each half are aligned end-to-end and connected by coupling means 25, and the base 14 is placed adjacent the bottom end of the lower pole 22. The two stakes 28 and 29 are placed adjacent the base and to opposite sides of the base and outside the playing area. The playing net 12 is extended between the two halves, and the net is connected to the eyelets 52. The net and poles are spread across the playing area, and the base 14 is secured to the ground as by inserting the spike 15 into the ground. The bottom pole for each half is inserted over the male stud 18 so that the end poles and net are now in a vertical position. One end for each of the guy lines 34 and 36 having looped ends are extended outwardly from the pole at an angle, and at that point a stake 28 is driven into the ground and the looped ends are affixed to the stake by hook 30. The other end of the guy lines 34 and 36 are similarly attached to a second stake 29. The guy lines are then adjusted by moving the cinch blocks to bring the poles into a vertical and upright position and to make the net taut. If, during play, the net or poles get out of alignment, the guy lines may be readjusted or tensioned so as to keep the net taut.

The foregoing detailed description has been given for clearness of understanding only, and no unnecessary limitations should be understood therefrom, as modifications will be obvious to those skilled in the art.

What is claimed is:

1. A portable net holding assembly for volley ball and the like, which comprises two identical halves, each half comprising:

(a) a substantially planar base member having (i) at least one downwardly depending spike adaptable for insertion into the ground adjacent the playing area for anchoring said base to the ground when in a deployed position, and (ii) an upwardly depending, centrally located male stud;

(b) an end pole having a longitudinal recess at one end thereof for accommodating said male stud;

(c) two elongated stakes adaptable to be inserted into the ground at spaced apart points remote from said base member and outwardly from the playing area whereby on assembly in a deployed position said stakes and said base member define a triangle, and each of said stakes having a hook near the exposed terminus when in a deployed position;

(d) a first line and a second line, said first line having looped termini releasably secured at each terminus to each of said stakes by said hook and extending from said pole and releasably connected thereto at a first point of convergence, and said second line having looped termini releasably secured at each terminus to each of said stakes by said hook and extending from said pole and releasably connected thereto at a second point of convergence longitudinally spaced from said first point of convergence, and adjustable means at each of said termini for said first and second lines to tension said lines when in a deployed position; and (e) said pole having longitudinally spaced connecting means for releasably connecting a net thereto.

2. A portable net holding assembly according to claim 1 wherein for each half said pole includes a lower pole with said longitudinal recess for accommodating said male stud, and an upper pole extendable from said lower pole on a common axis, and coupling means for releasably connecting said lower and upper poles in a deployed position.

3. A portable net holding assembly according to either claim 1 or 2 further including a net for connecting at one end thereof to said connecting means when in a deployed position.

* * * * *